United States Patent [19]

Smith et al.

[11] Patent Number: 4,533,464

[45] Date of Patent: Aug. 6, 1985

[54] TEETER BED ZONE DENSITY CONTROL DEVICE AND METHOD

[75] Inventors: Michael J. Smith, Granby; Allen L. Soucie, Ellington, both of Conn.

[73] Assignee: Linatex Corporation of America, Stafford Springs, Conn.

[21] Appl. No.: 498,150

[22] Filed: May 25, 1983

[51] Int. Cl.[3] ..... B03B 5/66; B03B 11/00

[52] U.S. Cl. ..... 209/158; 209/172.5; 209/454; 209/496

[58] Field of Search ..... 209/172.5, 496, 500, 209/491, 489, 454, 158–161; 73/438

[56] References Cited

U.S. PATENT DOCUMENTS

| | | | |
|---|---|---|---|
| 1,989,937 | 2/1935 | Lessing et al. | 209/158 |
| 2,715,462 | 8/1955 | Coulter | 209/159 |
| 2,715,463 | 8/1955 | Fitch | 209/159 |
| 2,960,226 | 11/1960 | Ekstrom | 209/158 |
| 3,235,072 | 2/1966 | Nelson | 209/172.5 |
| 4,136,567 | 1/1979 | Rosenblum | 73/438 |
| 4,252,097 | 2/1981 | Hartford et al. | 73/438 |
| 4,282,088 | 8/1981 | Ennis | 209/17 |
| 4,301,001 | 11/1981 | Lofthouse | 209/158 |

FOREIGN PATENT DOCUMENTS

| | | | |
|---|---|---|---|
| 1303067 | 1/1973 | United Kingdom | 209/158 |

*Primary Examiner*—Frank W. Lutter
*Assistant Examiner*—Wm. Bond
*Attorney, Agent, or Firm*—Prutzman, Kalb, Chilton & Alix

[57] ABSTRACT

A teeter bed density control device is disclosed in a hindered-settling fluid classifier of the type having a teeter fluid supply system in a chamber with a fluidized teeter bed zone, an overflow zone and an underflow discharge outlet with the control device comprising an upper sensor for measuring average particle density from the upper boundary of the teeter bed zone to the top of the overflow zone, a lower sensor for measuring average particle density from the lower boundary of the teeter bed zone to the top of the overflow zone, a controller connected to the sensors for generating a compensating control signal based upon a preselected density standard and the average density of the teeter bed zone as determinable from the upper and lower average particle density measurements, and an actuable valve for regulating the discharge of the underflow discharge outlet with the controller being connected to the valve for actuation thereof responsive to the compensating control signal. A method for controlling the density of a teeter bed zone of a hindered-settling fluid classifier is also disclosed including the steps of selecting a desired value of average density of the teeter bed zone, measuring the average particle density from the upper boundary of the teeter bed zone to the top of the overflow zone and from the lower boundary of the teeter bed zone to the top of the overflow zone, and regulating the underflow discharge in proportion to the measured average particle densities to adjust the average density of the teeter bed zone to the selected value.

6 Claims, 1 Drawing Figure

TEETER BED ZONE DENSITY CONTROL DEVICE AND METHOD

BACKGROUND AND SUMMARY OF THE INVENTION

The present invention relates to hindered-settling hydraulic classifiers and more particularly to a method and device for controlling the density of the teeter bed zone in a hindered-settling hydraulic classifier.

In hindered-settling hydraulic classifiers of the type generally described in United Kingdom Pat. No. 1,303,067 to Sidebottom, a zone or bed of particles is maintained in a densely composed teetering condition by an upward flow of water. This zone is referred to as a teeter bed zone and functions as the primary medium for particle size separation with finer particles remaining above the teeter bed zone for overflow removal and coarser particles settling downwardly through the teeter bed zone for underflow discharge removal. In wet classifying applications, the teeter bed zone is composed of particles having a structual size close to and somewhat coarser than the desired size of separation or classification of feed slurry particles, i.e., the desired cut point of classification. Maintenance of the proper density of the teeter bed zone is necessary for control of the operation of the classifier and to minimize the amount of overflow of coarse material with fine material and the amount of downward settling of fine material with coarse material.

Control of the density of the teeter bed zone is desirable for achieving a sharp product split and efficient classification of material as well as for minimizing the amount of fine material settling through the teeter bed zone with the coarse material. Prior devices such as the type disclosed in United Kingdom Pat. No. 1,303,067 generally utilized a single sensing unit for sensing density within the classifying chamber. Similar hindered-settling devices operated for specific gravity separation or concentration (rather than size classification) also utilize a single sensing unit for controlling the teeter bed zone, e.g., U.S. Pat. No. 4,282,088 to Ennis. Consequently, the control and maintenance of the teeter bed zone was based upon the measurement of a single sensing device which functioned to control the underflow discharge outlet. The accuracy of the sensing unit was however restricted by undesirable factors such as feed slurry density, feed fluctuations, etc., which adversely affected regulation of the underflow discharge outlet and thus the control of the density of the teeter bed zone.

Accordingly, it is a principal object of the present invention to provide a teeter bed density control device and method which provides accurate measurement and control of teeter bed zone density.

Another object of the invention is to provide a teeter bed density control device and method which accomplishes a more efficient classification of materials with sharper product splits and reduces the amount of fine material reporting with coarse material at higher feed loading rates.

A further object of the invention is to provide a teeter bed density control device and method which affords flexibility through facile variation of the composition of the products, close control over the size structure of the coarse underflow product, accurate control of the cut point of the separation, and convenient preselection of teeter bed density.

A still further object of the invention is to provide a teeter bed density control and method which compensates for variations in feed tonage and particle size composition while still maintaining the desired product split characteristics.

The foregoing and related objects are accomplished in a hindered-settling hydraulic classifier utilizing the teeter bed density control device of the present invention which includes a first sensor for measuring the average slurry density from the upper boundary of the teeter bed zone to the top of the overflow zone, a second sensor for measuring the average slurry density from the lower boundary of the teeter bed zone to the top of the overflow zone, and a controller connected to the sensors for generating a compensating control signal based upon a preselected density standard and the average slurry density measurements. An actuable control valve for regulating the flow of discharge through the underflow discharge outlet is operationally connected to the controller to regulate discharge responsive to the compensating control signal.

In the method of the present invention for controlling the density of the teeter bed zone, the desired value of average teeter bed zone density is selected and the average slurry density is measured from the upper boundary of the teeter bed zone to top of the overflow zone and from the lower boundary of the teeter bed zone to the top of the overflow zone. The underflow discharge is regulated in proportion to the measured average slurry densities to adjust the average density of the teeter bed zone to the selected value. Measuring the average slurry densities includes the determination of the average teeter bed zone density with the regulation of the underflow discharge being based upon the average value and the selected value of the teeter bed zone density.

DESCRIPTION OF THE PREFERRED EMBODIMENT

Figure 1:
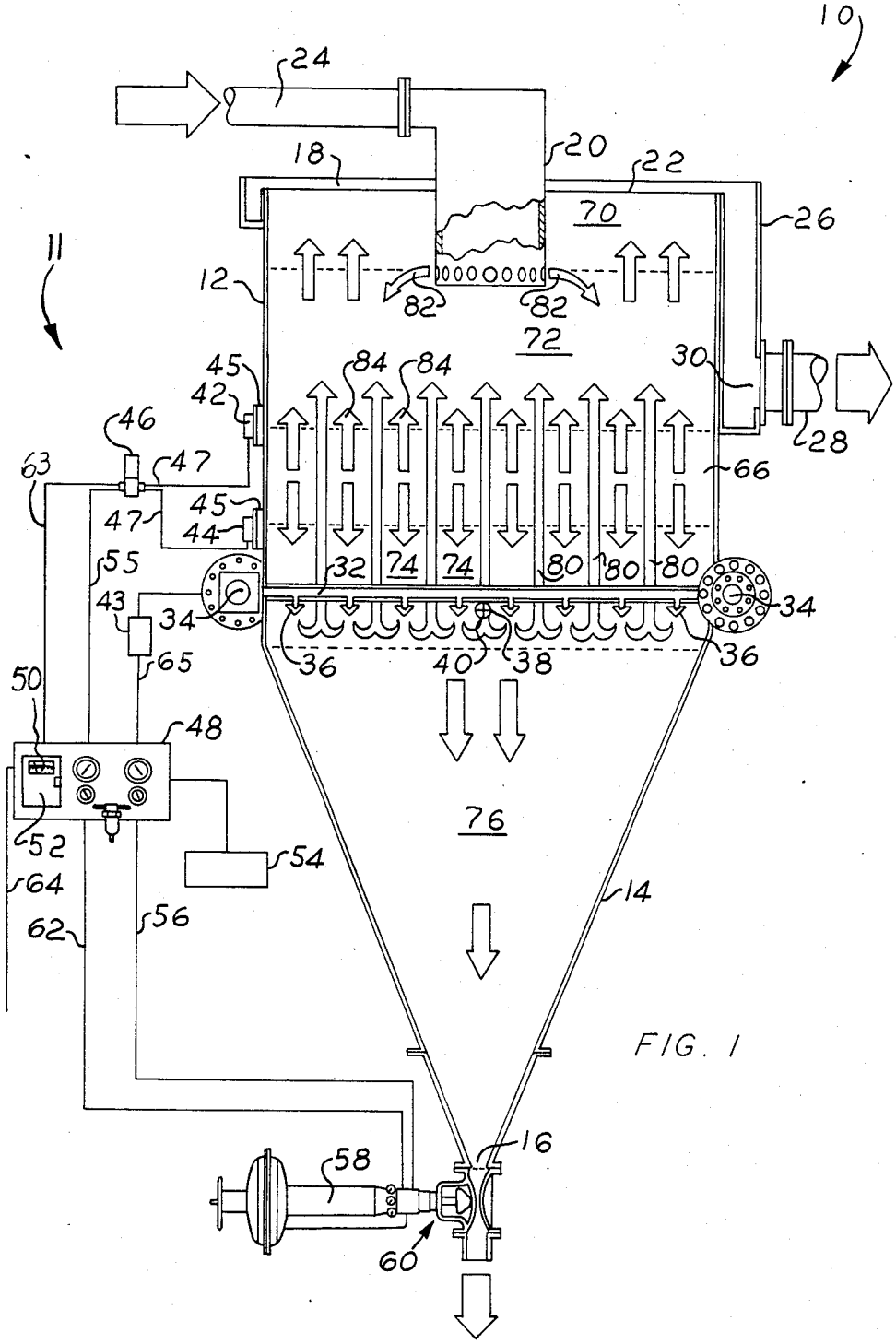
FIG. 1 is a partially diagrammical sectional view of a hindered-settling hydraulic classifier embodying the teeter bed density control of the present invention.

Referring to FIG. 1, a hindered-settling hydraulic classifier 10 is shown embodying the teeter bed density control device of the present invention which is generally designated by the numeral 11.

The classifier 10 comprises an upper sorting chamber 12 generally of retangular cross-sectional configuration and a lower collecting cone portion 14 which terminates in an underflow discharge outlet 16. The top edge of the upper sorting chamber 12 is fitted with a continuous, adjustable overflow weir plate 18. A cylindrical feed well 20 is positioned centrally within the sorting chamber 12 and extends below the overflow weir level 22. The feed well 20 is connect to an inlet feed slurry line 24.

A sloping peripheral collecting launder 26 extends continuously on one side of the sorting chamber 12. A discharge line 28 for overflow product is connected to an outlet port 30 located at the bottom of the launder 26.

An array of closely spaced parallel water injection pipes 32 is mounted at the lower end of the upper sorting chamber 12. Water supply manifolds 34 are located on opposite sides of the sorting chamber 12 and are connected to the water injection pipes 32 to supply pressurized water thereto. The water injection pipes 32 contain a plurality of spaced injection nozzles 36 for injecting pressurized water into the sorting chamber 12. Control valving and flow measurement instrumentation (not shown) is provided upstream of the water supply manifolds 34 to regulate the water supplied to water pipes 32 and injection nozzles 36. This water injection system, including water pipes 32 and injection nozzles 36, is commonly referred to as the "teeter water system." A separate water system referred to as a "compensating water system" is also provided for the purpose of compensating for teeter water loss during operation of the classifier and includes a water supply manifold 38 having discharge nozzles 40 below the array of water injection pipes 32. The water supply manifold 38 is connected to a regulated source of water (not shown) and is controlled by the control device 11.

The density control device 11 comprises a pair of spaced apart pressure sensors 42, 44 interconnected by a differential pressure transmitter 46 to a signal processor and control panel 48. The pressure sensors 42, 44 are mounted to flanged ports 45 of chamber 12 and include a diaphragm-type sensing element to sense the pressure level within chamber 12 at the mounting positions. The differential pressure transmitter 46 is connected to sensors 42, 44 by liquid-filled sealed conduits 47 and functions to determine the differential pressure between the sensors 42, 44 and transmit a pneumatic differential pressure measurement signal via the input line 55 to the control panel 48. An acceptable differential pressure transmitter-sensor assembly is the Model No. 13 DMP series differential pressure transmitter sold by The Foxboro Company of Foxboro, Mass. Other acceptable pneumatic or electronic sensor assemblies may also be utilized.

The control panel 48 is of conventional design for processing the input signals from the transmitter 46 and generating a control signal based upon those input signals. The control panel 48 includes an indicator display meter assembly 50 for displaying a direct measurement of density and a control set knob 52 for selecting a standard or desired value of density. In operation, the control panel 48 continuously detects the difference between the differential pressure measurement signal and the standard value as set by the knob 52 and produces a pneumatic output signal, i.e., a compensating control signal, which is a function of or based upon this detected difference. The standard value as set by the knob 52 and the generated compensating control signal are also displayed on the meter assembly 50. A visual performance monitor 54, such as a continuous graph recorder or a video receiver display, can be connected to control panel 48 to provide a visual display of various parameters indicative of the operation of the control device 11. An acceptable control panel for use in the present invention is the Model 43AP Pneumatic Controller sold by The Foxboro Company of Foxboro, Mass. Other pneumatic or electronic controller means may be acceptable for generating a control signal based upon a predetermined density standard and the average density measurements from the sensors.

A pneumatic control signal line 56 interconnects the control panel 48 to the pneumatic valve actuator 58 of the pinch valve assembly 60 to actuate the pinch valve assembly 60 responsive to the compensating control signal generated by the control panel 48. The pinch valve assembly 60 is mounted to the lower collecting cone 14 at the underflow discharge outlet 16 to regulate the flow therethrough by incrementally opening and closing off the discharge outlet 16. An acceptable underflow valve assembly is the Model D & F Pinch Valve sold by the Linatex Corporation of America, Stafford Springs, Conn., with a Model A-46 Pneumatic Actuator sold by ITT Hammel-Dahl of Warwick, R.I.

Pressurized air is used to power the valve actuator 58 and is supplied from the control panel 48 to the valve actuator 58 by air supply line 62. Similarly, pressurized air is supplied to the differential pressure transmitter 46 by air supply line 63. A source of pressurized air (not shown) is connected to the control panel 48 by air supply line 64 to provide the necessary pressurized air for the operation of the control device 11.

The control panel 48 may also be utilized to control the compensating water system. In the illustrated embodiment, the pneumatic control signal line 65 connects the control panel 48 to a pneumatic control 43 which regulates the flow of water through the water supply manifold 38. Thus, additional water is added to the teeter water system as a function of the compensating control signal generated by the control panel 48 to compensate for teeter water loss during operation.

To initially prepare the classifier 10 for operation, the upper sorting chamber 12 is filled to the overflow weir 18 with water. A predetermined rising current of "teeter water" depicted by flow arrows 80 is introduced through the injection nozzles 36 of the teeter water system. A feed slurry comprised of particles of different sizes having similar specific gravities is delivered to the feed well 20 by gravity or pumping. The feed slurry discharges regularly from the bottom of the feed well 20 dispersing initially as depicted by flow arrows 82 in an outward direction from which most particles that are substantially finer than the desired measure or cut point of classification will rapidly rise and report to the overflow collecting launder because their hindered-settling velocity is lower than the velocity of the upward rising current 80. Particles in the feed slurry which are near size to or coarser than the classification point will move downwards into the teeter bed zone 66 because their hindered-settling velocity is higher than the velocity of the upper rising current 80. As is known in the art, the teeter water upward flow rate is maintained at a rate to maintain a zone or bed of particles in a densely composed teetering condition. The teeter bed zone is formed of particles from the feed slurry with a size very close to and somewhat coarser than the desired separation or classification to be attained by the classifier.

Functionally, the teeter bed zone 66 serves as the primary medium for particle size separation (or alternatively gravity separation) and is controllably maintained within a limited vertical range above the array of water injection pipes 32 and below the upper portion of sorting chamber 12 and the feed slurry entry area which is a somewhat turbulent region influenced by momentary fluctuations in feed supply and particle size distribution. The teeter water injection rates will vary according to the desired size separation (or gravity separation) being performed.

For purposes of explanation of operation, the classifier 10 is divided into identifiable zones above and below the teeter bed zone 66. The uppermost zone is an overflow zone 70 which is occupied by particles (or fines) of the size desired for the overflow product removed through the discharge line 28. Below overflow zone 70 is the upper sorting zone 72 which is a somewhat turbulent zone with varing pulp density resulting from momentary fluctuations in the incoming feed and which contains the full range of particle size distribution present in the feed slurry. The upper sorting zone 72 adjoins the teeter bed zone 66 which is characterized as a controlled hindered-settling zone occupied predominately by particles at or near size to the mesh size of separation, or coarser.

Directly below the teeter bed zone 66 is a teeter water injection zone 74 which is a semi-turbulent zone populated by only those coarser solids which are in transit to the underflow collecting chamber or zone 76. The underflow collecting zone 76 contains a very dense, coarse solid product having sufficient water content to permit continuous gravity flow downward through the underflow discharge outlet 16.

The nature of the teeter bed zone 66 is critical to the separation by size of the overflow products (fines) from the underflow products (coarse). The size of the particles of the teeter bed zone determine the classification point of separation while the density of the teeter bed zone will affect the rate of classification, the sharpness of the products split and the amount of fine product which will settle down (undesirably) through the teeter bed zone along with the coarse product. Accurate control of the nature of the teeter bed zone is therefore necessary for advantageous control over these as well as other operational characteristics of the wet classifier.

As seen in FIG. 1, the pressure sensor 42 is positioned adjacent the upper boundary of the teeter bed zone 66 to sense the pressure at that level. In the illustrated configuration, the pressure sensor 42 measures the average slurry density from the upper boundary of the teeter bed zone 66 to the top of the overflow zone 70. Likewise, the pressure sensor 44 is mounted adjacent the lower boundary of the teeter bed zone 66 and measures the average slurry density from the lower boundary of the teeter bed zone 66 to the top of the overflow zone 70. The differential transmitter 46 determines the difference between the sensor measurements and transmits a differential measurement signal to the control panel 48. The control panel 48 determines the difference between the differential measurement signal and the "set point" or desired density standard as selected by rotation of the control set knob 52. If the measured density is less than the desired density, the pinch valve assembly 60 is actuated by the generated compensating control signal to restrict the discharge of coarse material through underflow discharge outlet 16 thereby increasing the average density of the teeter bed zone 66. Conversely, if the measured density is greater than the desired density, the pinch valve assembly 60 is regulated to increase the discharge through discharge outlet 16 to purge the excess coarse material and thereby decrease the density of the teeter bed zone 66. Accordingly, the underflow discharge is regulated to adjust the average density of the teeter bed zone to approximately the preselected standard value. Thus, the density control device 11 maintains the average density of the teeter bed zone at approximately the preselected value during the operation of the classifier 10.

The accuracy of the measurement of the density of the teeter bed zone 66 as determined by the pressure sensors 42, 44 is not affected by the density of the material in the upper sorting zone or in the overflow zone as was the case with prior control devices. Consequently, the determination of teeter bed density by control device 11 is not adversely affected by graphic fluctuations in feed density and the accurate density measurement attained results in a more efficient classification with sharper product splits. The control device 11 will continue to measure and maintain the teeter bed zone density during the operation of the classifier 10 and thereby automatically compensate for variations in feed, particle size, etc. Significant reductions in the amount of fine material reporting with the coarse material is also attained thereby allowing for more efficient downstream processing of the underflow coarse material.

Moreover, there is considerable flexibility in the operation of the classifier through the ability to vary the composition of the products through accurate adjustment of the teeter bed zone density. The set point of classification is easily changed by knob 52.

As a classifier or sizing device, the hindered-settling hydraulic classifier of the present invention is capable of making sharp, wet classifications in the range of 16–150 mesh (1190 microns to 105 microns). The feed slurry is normally pre-sized so as to have a maximum particle size of about one-quarter inch (6 mm). The preferential range of use is in the range of 20–100 mesh.

The classifier of the present invention is believed particularly desirable for sizing in closed circuit grinding processes because of the inherent difficulties encountered when finer material is included in the underflow product. The density control device and method may also be advantageously utilized as a specific gravity separator as, for example, the separation of one mineral from another by making use of the difference in their individual specific gravities. Increased versality can also be attained in the patented process for fine coal cleaning in U.S. Pat. No. 4,287,088 since the control device 11 permits the gravity of separation to be varied with precision. Other beneficial applications include washing, deslimming and the neutralization of acedic slurries.

Thus it can be seen that a new and improved teeter bed density control and method have been provided which attains accurate measurement and control of teeter bed zone density in a classifier. As will be apparent to persons skilled in the art, various modifications and adaptations of the structure above described will become readily apparent without departure from the spirit and scope of the invention, the scope of which is defined in the appended claims.

We claim:

1. A method of controlling the density of a teeter bed zone of a hindered-settling fluid classifier having an overflow zone wherein said teeter bed zone has upper and lower boundaries comprising the steps of:

selecting a desired value of average density of the teeter bed zone, measuring the average particle density from the upper boundary of the teeter bed zone to the top of the overflow zone and from the lower boundary of the teeter bed zone to the top of the overflow zone, comparing said measured average particle densities to obtain a differential therebetween, and regulating the underflow discharge in proportion to the deviation of the differential of said measured average particle densities and said selected value to adjust the average density of the teeter bed zone to approximately said selected value.

2. The method of claim 1 wherein the step of measuring the average particle densities includes the step of determining the average teeter bed zone density from the average particle density measurements and the step of regulating the underflow discharge includes regulating the underflow discharge based upon the average teeter bed zone density and the selected value of average teeter bed zone density.

3. The method of claim 2 wherein the step of regulating the underflow discharge includes proportionally increasing the underflow discharge when the determined average teeter bed zone density is greater than the selected value and proportionally decreasing the underflow discharge when the determined average teeter bed zone density is less than the selected value.

4. The method of claim 1 wherein the steps of measuring the average particle densities and regulating the underflow discharge are continuously repeated during the operation of the classifier.

5. The method of claim 1 wherein the classifier is a hydraulic classifer and, measuring the average particle density comprises measuring the average slurry density from the upper boundary of the teeter bed zone to the top of the overflow zone and from the lower boundary of the teeter bed zone to the top of the overflow zone, regulating the underflow discharge comprises regulating the underflow discharge in proportion to said measured average slurry densities to adjust the average density of the teeter bed zone to said selected value and, further comprising the step of adding additional water to the teeter bed water system based upon the measurement of the average slurry densities.

6. The method of claim 1 comprising determining the average density of the teeter bed zone and visually displaying said average density on a visual display means.

* * * * *